US012286863B2

(12) United States Patent
Zahur et al.

(10) Patent No.: US 12,286,863 B2
(45) Date of Patent: Apr. 29, 2025

(54) ANNULUS ACCESS SYSTEMS AND METHODS

(71) Applicant: SAUDI ARABIAN OIL COMPANY, Dhahran (SA)

(72) Inventors: Jawad Zahur, Abqaiq (SA); Akram R. Al-Barghouti, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 155 days.

(21) Appl. No.: 18/310,887

(22) Filed: May 2, 2023

(65) Prior Publication Data

US 2024/0368963 A1 Nov. 7, 2024

(51) Int. Cl.
*E21B 34/02* (2006.01)
*E21B 19/24* (2006.01)

(52) U.S. Cl.
CPC ..... *E21B 34/025* (2020.05); *E21B 19/24* (2013.01)

(58) Field of Classification Search
CPC ..... E21B 33/068; E21B 33/072; E21B 34/025
See application file for complete search history.

(56) References Cited

U.S. PATENT DOCUMENTS 2,696,261 A * 12/1954 Ennis ..... E21B 33/072 166/75.14
4,839,644 A * 6/1989 Safinya ..... E21B 47/13 340/854.6
4,972,904 A * 11/1990 Godare ..... E21B 33/03 166/85.1
6,315,046 B1 * 11/2001 Jack ..... E21B 37/08 166/368
8,820,400 B2 * 9/2014 McGuire ..... E21B 33/068 166/177.5
2002/0134548 A1 * 9/2002 Lam ..... E21B 33/068 166/88.1
2003/0010498 A1 * 1/2003 Tolman ..... E21B 43/2607 166/305.1

(Continued)

OTHER PUBLICATIONS

Obaid, Hashem, Ashby, Scott, El Sheshtawy, Mohamed, and Niyaz Ikhsanov. "High Definition Acoustic and Temperature Logging for the Diagnosis of Complex Annuli Leaks and Communication." Paper presented at the Abu Dhabi International Petroleum Exhibition & Conference, Abu Dhabi, UAE, Nov. 2021.

(Continued)

*Primary Examiner* — Shane Bomar
(74) *Attorney, Agent, or Firm* — Vorys, Sater, Seymour and Pease LLP

(57) ABSTRACT

A well system includes a wellhead arranged at a well surface and having a wellbore extending therefrom, the wellhead including a production tubing head housing, production casing extending from the wellhead and into the wellbore, production tubing extending from the production tubing head housing and into the production casing and thereby defining a tubing-casing annulus between the production tubing and the production casing, one or more side outlets extending outwardly from the production tubing head housing at an acute angle and in fluid communication with the tubing-casing annulus, and a downhole assembly conveyable into the tubing-casing annulus via the one or more side outlets and configured to obtain direct measurements of the tubing-casing annulus.

18 Claims, 2 Drawing Sheets

(56) References Cited

U.S. PATENT DOCUMENTS

| | | | | |
|---|---|---|---|---|
| 2004/0206507 | A1* | 10/2004 | Bunney | E21B 33/068 166/312 |
| 2017/0204714 | A1* | 7/2017 | Roesner | E21B 33/03 |
| 2021/0047919 | A1* | 2/2021 | Littleford | G01F 23/284 |
| 2021/0054697 | A1* | 2/2021 | Dokhon | E21B 33/03 |
| 2022/0282615 | A1* | 9/2022 | Alghazali | E21B 47/06 |

OTHER PUBLICATIONS

Expro Octopoda™—Annulus Intervention Services; retrieved from https://www.expro.com/products-services/well-intervention/well-technology/annulus-intervention-services (2023).

Sonnier, Baine, and Mark Sackash. "Intervening With Coiled Tubing Through the Tubing-Casing Annulus to Restore Well Control." Paper presented at the SPE/ICoTA Coiled Tubing and Well Intervention Conference and Exhibition, The Woodlands, Texas, USA, Apr. 2008.

* cited by examiner

ANNULUS ACCESS SYSTEMS AND METHODS

FIELD OF THE DISCLOSURE

The present disclosure relates generally to wellhead designs for use in the oil and gas industry and, more particularly, to tubing head housings capable of providing particular access to annuli between production tubing and production casing.

BACKGROUND OF THE DISCLOSURE

Wellheads are a required and essential component for every oil and gas well drilled and completed for production. Wellheads serve a variety of purposes, including providing load support for each tubular run (extended) into the wellbore and facilitating the production of formation fluids. Most importantly, wellheads act as a barrier between the wellbore and the atmosphere. Thus, wellheads play a major role in the maintenance of well integrity and the safety of the environment.

During production of formation fluids, operators must certify the enduring integrity of installed well barriers. To ensure well barrier integrity, operators often deploy downhole measurement tools to identify changes in temperature and or flow that may be indicative of a potential well barrier leak or failure. Due to the configuration of conventional wellheads, downhole measurements are commonly taken through the production tubing. Consequently, the measurement tools, such as temperature sensors or flow meters, lack direct access to the annulus defined between the production tubing and the production casing in which the production tubing extends. As a result, conventional well integrity surveys, such as temperature or flow meter surveys, are generally performed through the walls of the production tubing, and this results in data that is oftentimes inconclusive. Alternatively, the production tubing can be entirely removed from the wellbore and survey instruments can subsequently be deployed downhole within the production casing to determine the location leaks or failures. As will be appreciated, this can be a time-consuming and costly process.

What is needed is a more precise system and method to access the annulus between the production tubing and the production casing, and thereby obtain higher quality data that will improve safety surveys, thus making decision making easier on integrity issues.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellhead arranged at a well surface and having a wellbore extending therefrom. The wellhead may include a production tubing head housing with a production casing extending from the wellhead and into the wellbore. The wellhead may further include a production tubing extending from the production tubing head housing and into the production casing and thereby defining a tubing-casing annulus between the production tubing and the production casing with one or more side outlets extending outwardly from the production tubing head housing at an acute angle and in fluid communication with the tubing-casing annulus. The well system may further include a downhole assembly conveyable into the tubing-casing annulus via the one or more side outlets and configured to obtain direct measurements of the tubing-casing annulus.

According to an embodiment consistent with the present disclosure, a method of obtaining downhole measurements may include opening a valve in a side outlet of a production tubing head housing forming part of a wellhead, wherein a wellbore may extend from the wellhead and production casing extends from the wellhead and into the wellbore, and wherein production tubing extends from the production tubing head housing and into the production casing and thereby defines a tubing-casing annulus between the production tubing and the production casing. The method may include introducing a downhole assembly into the side outlet, wherein the side outlet extends outwardly from the production tubing head housing at an acute angle and is in fluid communication with the tubing-casing annulus. The method may further include conveying the downhole assembly into the tubing-casing annulus via the side outlet and obtaining direct measurements of the tubing-casing annulus with the downhole assembly while present within the tubing-casing annulus.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
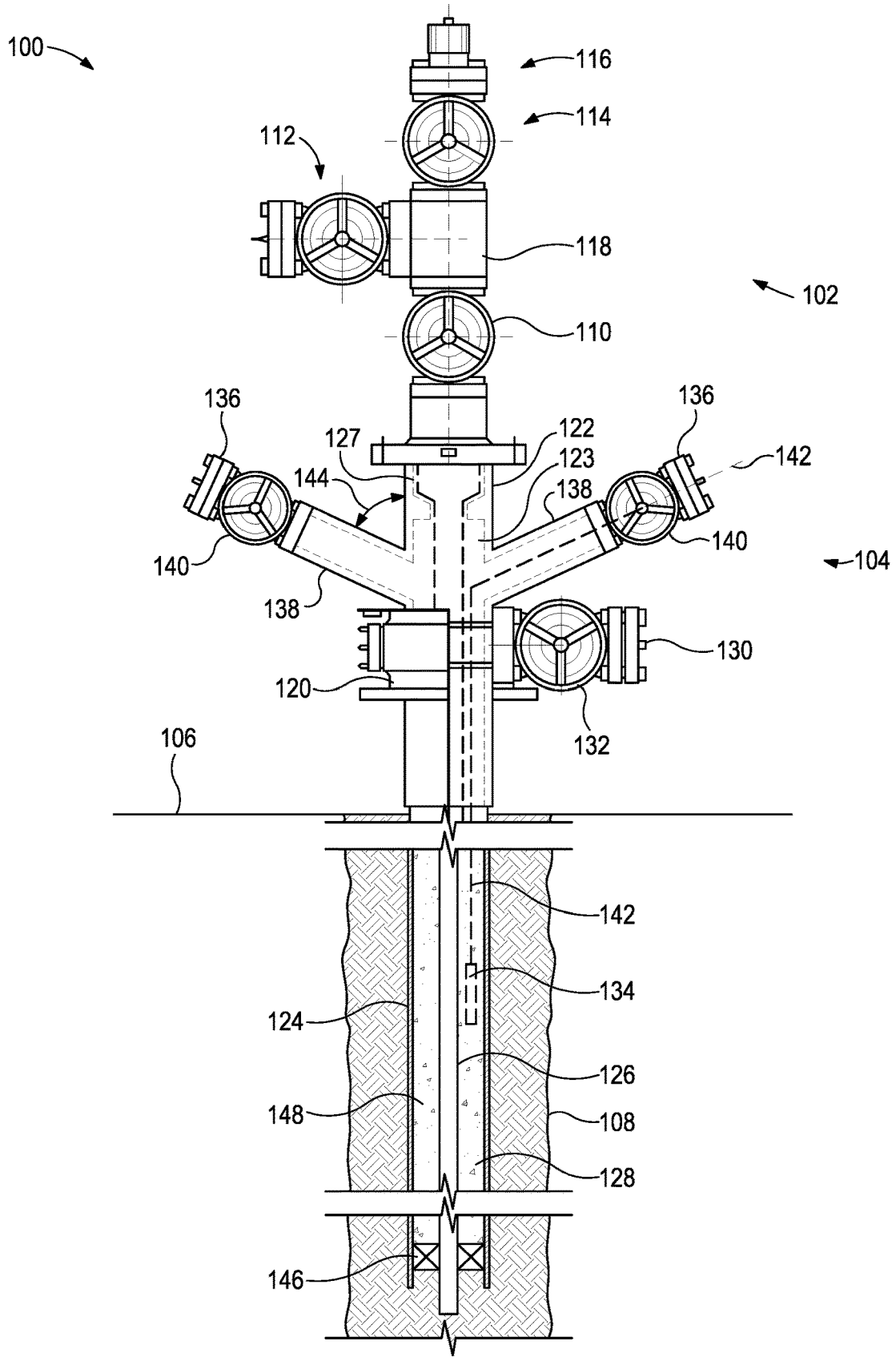
FIG. 1 is a schematic, partial cross-section side view of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been apparent to one of ordinary skill in the art that the scale of the elements presented in the accompanying Figures may vary without departing from the scope of the present disclosure.

Embodiments in accordance with the present disclosure generally relate to wellhead designs in the oil and gas industry and, more particularly, to tubing head housings capable of providing downhole logging tool access to the annulus defined between the production tubing and the production casing positioned radially outward from the production tubing. Embodiments described herein disclose a well system that includes a wellhead arranged at a well surface and having a wellbore extending therefrom. Production casing extends from the wellhead and into the wellbore, and production tubing extends from a production tubing head housing of the wellhead and into the production casing, thereby defining a tubing-casing annulus between the production tubing and the production casing. The production tubing head housing may include one or more side outlets that extend outwardly at an acute angle and are in fluid communication with the tubing-casing annulus. A downhole assembly may be conveyable into the tubing-casing annulus via the one or more side outlets, and while present within the tubing-casing annulus, the downhole assembly may be operable to obtain direct measurements of the tubing-casing annulus.

FIG. 1 is a schematic, partial cross-sectional side view of an example well system 100 that may employ the principles of the present disclosure, according to one or more embodiments. As illustrated, the well system 100 includes a production tree 102 operatively coupled to and in fluid communication with a wellhead 104 positioned on the Earth's surface 106 and extending over and around a wellbore 108. The wellhead 104 may be used for production operations, but could alternatively be used for drilling and completion operations. In such applications, the production tree 102 (alternately referred to as a "Christmas" tree) would not be present.

While the well system 100 is depicted as a land-based operation, it will be appreciated that the principles of the present disclosure could equally be applied in any offshore, sea-based, or sub-sea application where the production tree 102 and wellhead installation 104 may be arranged on a floating platform, a semi-submersible platform, or may comprise a sub-surface wellhead installation as generally known in the art. As used herein, the term "operatively couple." and any grammatical variants thereof, refers to a direct or indirect coupling engagement between two components.

As illustrated, the production tree 102 may comprise a configuration of valves and spools operable to direct and control the flow of formation fluids from the wellbore 108. In other embodiments, the production tree 102 may be used to control the injection of fluids (e.g., $CO_2$, water, etc.) into the wellbore 108. Accordingly, the production tree 102 may be configured with the valves and spools necessary to carry out the requirements of the planned operation. In the illustrated embodiment, the production tree 102 may include a master valve 110, one or more wing valves 112, a swab valve 114, and a tree cap 116. The master valve 110 may comprise a generally exterior cylindrical body, the lower portion of which may be operatively coupled to and in fluid communication with the uppermost portion of the wellhead 104. The master valve 110 may control all fluid flow from the wellbore 108 to the surface 106. While a single master valve 110 is depicted, the production tree 102 could include a second master valve consecutively arranged and operatively coupled to the first (primary) master valve 110.

The upper portion of the master valve 110 may be operatively coupled to and in fluid communication with a flow tee 118 (alternatively referred to as "flow cross 118"). The flow tee 118 is operable to direct and manage multi-directional fluid flow above the master valve 110, and further serves as the connection point between the master valve 110, the swab valve 114, and the wing valve(s) 112.

The swab valve 114, alternatively referred to as a "crown valve", is positioned atop the flow tee 118 and may comprise the uppermost valve of the production tree 102. The swab valve 114 may be functional to provide, or similarly restrict, vertical access to the production tree 102, the wellhead 104, and more particularly, the wellbore 108. As will be discussed below, in conventional wellbore interventions or well measurement operations, the swab valve 118 may serve as the point of entry for downhole tools and assemblies to be extended into the wellbore 108 to undertake a variety of operations.

The flow tee 118 comprises three internal orifices or flowpaths (not visible) operable to receive and direct fluid. A first or "uppermost" orifice may fluidly communicate with the swab valve 114, a second or "side" orifice may fluidly communicate with the wing valve 112, and a third or "lowermost" orifice may fluidly communicate with the master valve 110. When the master valve 110 is an "open" position and the swab valve 114 is in a "closed" position, formation fluid(s) entering the production tree 102 from below (i.e., from the wellbore 108 and through the wellhead 104) may flow through the master valve 110, and the flow tee 118 will re-direct the formation fluid(s) 90° toward the wing valve 112. The wing valve 112 is operable to permit or restrict the flow of formation fluid(s) to downstream locations.

The tree cap 116 (alternately referred to as a "tree adapter") is the uppermost component of the well system 100 and is operatively coupled to the swab valve 114. The tree cap 116 may be removed so as to provide the initial point of entry for any downhole assemblies and tools that may be extended into the well system 100.

The wellhead 104 may comprise a configuration of housings and spools operatively coupled to one or more discrete tubulars extended into the wellbore 108. The uppermost extension of each discrete tubular is secured within a respective housing or spool forming part of the wellhead 104. The wellhead 104 may thus provide load support for the suspended tubular(s). In addition, the wellhead 104 serves as a well barrier operable in preventing the release of formation fluids to the atmosphere, as well as a point of entry and access to the interior of the wellbore 108 once the well is put on production.

In the illustrated embodiment, the wellhead 104 includes at least a casing head housing 120 and a production tubing head housing 122. A string of casing 124, alternately referred to as "production" casing, extends from the casing head housing 120 and into the wellbore 108. The production casing 124 may be secured within and in fluid communication with the casing head housing 120. The casing head housing 120 may include a generally cylindrical exterior body with an interior that defines a bowl operable to receive and suspend the production casing 124. More specifically, the production casing 124 is received by an internal casing hanger provided within the bowl and operable to both suspend the production casing 124 and provide a sealed interface.

Although not shown, the wellhead 104 may further include a second or "lowermost" casing head housing operatively coupled to a string of surface casing (not shown) extended into the wellbore. In such embodiments, the production casing 124 may be concentrically arranged within the interior of the surface casing.

As illustrated, the casing head housing 120 may further include one or more side outlets 130 (one shown) operable to provide access to an annulus defined between the exterior of the production casing 124 and the inner wall of the wellbore 108 or a tubular (casing) arranged radially outward from the production casing 124. The side outlet 130 may include a gate valve 132 operable to open or close and thereby facilitate one or more downhole operations, such as injecting fluids into the annulus, and relieving built up pressure within the annulus. In some embodiments, the side outlet(s) 130 may be equipped with a pressure gauge operable to display the real-time pressure of the annulus.

A string of production tubing 126 may also be extended into the wellbore and concentrically arranged within the production casing 124. The production tubing 126 may extend to the distal end of the wellbore 108 and provide a conduit that receives formation fluids (e.g., oil, gas, and formation water) that may enter the wellbore 102 naturally, via perforations, or by some means of artificial lift or inducement. When the master valve 110 is opened, the formation fluids may travel up the production tubing 126 to the surface 106 for production.

The production tubing 126 may extend from the production tubing head housing 122, which may include a generally cylindrical exterior body and an interior that defines a bowl 123 (shown in dashed lines) operable to receive the production tubing 126. The bowl 123 may define a tubing hanger 127 operable to both suspend the production tubing 126 and provide a sealed interface, which may isolate a tubing-casing annulus 128 defined between the production tubing 126 and the production casing 124. In other embodiments, the production tubing 126 may be secured and suspended via a tubing head adapter (not shown) that may be positioned directly atop the production tubing head housing 122 and below the production tree 102.

Conventional production tubing head housings generally include one or more side outlets extending perpendicularly outward from the exterior body of the housing. Like the side outlets 130 of the casing head housing 120, side outlets of conventional production tubing head housings may be operable to provide surface (external) access to the tubing-casing annulus 128 to measure pressure within the tubing-casing annulus 128, bleed fluids from the tubing-casing annulus 128, or inject fluids into the tubing-casing annulus 128, as needed. Accordingly, side outlets on conventional production tubing head housings may further include one or more valves and pressure gauges.

Conventional production tubing head housings, however, are not designed for the introduction or conveyance of downhole assemblies into the tubing-casing annulus 128 via the side outlets. Accordingly, survey measurements within the tubing-casing annulus 128 are conventionally undertaken by extending downhole tools or assemblies into the production tubing 126 and obtaining readings, such as temperature and flow rate, through the walls of the production tubing 126. Such a configuration, may not be conclusive in determining whether there is a leak within the production casing 124, a packer, or similarly any additional well barrier in direct contact with the tubing-casing annulus 128.

According to embodiments of the present disclosure, the production tubing head housing 122 may be "intervenable" and otherwise configured to allow a downhole tool or assembly 134 to be conveyed into the tubing-casing annulus 128 from the production tubing head housing 122. As illustrated, the production tubing head housing 122 includes one or more side outlets 136 (two shown) that extend outwardly from the exterior body of the production tubing head housing 122. More specifically, each side outlet 136 includes an outward flange 138 extending from the production tubing head housing 122, and a gate valve 140 may be arranged within the outward flange 138. Opening the corresponding gate valve 140 allows a well operator to introduce the downhole assembly 134 into the tubing-casing annulus 128 from the production tubing head housing 122.

The downhole assembly 134 may be conveyed into the tubing-casing annulus 128 on a conveyance 142, which may comprise any type of conveyance capable of introducing and otherwise injecting the downhole assembly 134 into the tubing casing annulus 128. In some embodiments, for example, the conveyance 142 may comprise slickline or wireline. In such embodiments, the corresponding side outlet 136 and, more particularly, the outward flange 138, may be operatively coupled to a wireline or slickline injection assembly (not shown). In other embodiments, however, the conveyance 142 may comprise coiled tubing or the like. In such embodiments, the corresponding side outlet 136 and, more particularly the outward flange 138, may be operably coupled to a coiled tubing injection assembly (not shown).

The downhole assembly 134 may comprise a variety of downhole tools, sensors, gauges, logging tools, or any combination thereof, and the downhole assembly 134 may be configured to obtain direct measurements within the tubing-casing annulus 128, as opposed to indirect measurements while arranged within the production tubing 126. Examples of the downhole assembly 134 include, but are not limited to, a logging tool, a temperature sensor, a pressure sensor, a flow meter, or any combination thereof. Example logging tools include, but are not limited to, a corrosion logging tool, a gamma ray tool (sensor), a noise logging tool, a directional gyro tool, and similar. In embodiments where the downhole assembly 134 comprises a logging tool, the logging tool may be capable of detecting failures in the production casing 124, such as leaks or other properties indicative of a failure or potential failure. In other embodiments, the logging tool may comprise a gamma ray sensor, an acoustic sensor and or a casing collar locator. In embodiments where the downhole assembly 134 comprises a temperature sensor, the temperature sensor may be able to directly contact a leak path in the production casing 124, which may be able to provide accurate data for the wellbore 108. In embodiments where the downhole assembly 134 comprises a flow meter, the flow meter may be operable to physically and directly pinpoint a leak point in the production casing 124. In such embodiments, remedial operations can be quickly planned following detection of the leak.

In some embodiments, as illustrated, the side outlets 136 may extend outwardly from the production tubing head housing 122 at an acute angle 144 relative to a central (longitudinal) axis of the wellhead 104. The angle 144 may range between about 10° and about 75°, and including any angle therebetween. In at least one embodiment, the angle 144 may be approximately 45°. The acute angle 144 of the side outlet(s) 136 may be advantageous as the inclination may assist in conveying the downhole assembly 134 to the tubing-casing annulus 128. Some logging tools, for example, do not have the ability to navigate a severe turn (e.g., dogleg), accordingly the angle 144 allows the downhole assembly 134 to be conveyed through the side outlet(s) 136 with case.

Once conveyed through the side outlet(s) 136, continued advancement of the conveyance 142 may lower the downhole assembly 134 into the tubing-casing annulus 128 and toward the distal end of the wellbore 108. As the downhole assembly 134 descends within the tubing-casing annulus 128, the gauges and sensors of the downhole assembly 134 may be able to directly access and log the tubing-casing annulus 128, as opposed to doing so through the sidewalls of the production tubing 126 (i.e., indirectly). The readings or data obtained by the downhole assembly 134 may be helpful in determining the position of an existing leak or well barrier failure. Similarly, in some embodiments, the diameter or size of the downhole assembly 134 may be increased, depending upon the size of the production casing 124 and the production tubing 126.

In some embodiments, the outward flange 138 may extend from the production tubing head housing 122 at a length of about 1 meter (approx. 3.28 feet). In some embodiments, the outward flange 138 may have a length of about 1.5 meters (approx. 4.92 feet), without departing from the scope of the disclosure. In any embodiment, the outward flange 138 may be a length operable to receive pressure control equipment within the space constraints of the well location.

Prior to putting the well on production, the well operator may install additional well barriers to maintain the integrity of the wellbore 108. As an example, in order to specifically maintain the integrity of the production casing 124 (e.g., a secondary well barrier when the production tubing 126 is in place) the well operator may install a packer 146 within the tubing-casing annulus 128 to prevent produced formation fluids from contacting the interior of the production casing 124, and thereby resulting in corrosion and/or deterioration of the production casing 124. The packer 146 may interpose the production casing 124 and the production tubing 126 and may be deployed within the tubing-casing annulus 128 a predetermined distance above (uphole from) a producible reservoir, and thereby forming the bottom of the tubing-casing annulus 128. Once the reservoir begins to produce, the packer 146 will prevent the formation fluids from entering the tubing-casing annulus 128 above the packer 146. In such an embodiment, once tested and qualified, the packer 146 may be deemed a well barrier. Moreover, in some embodiments, prior to deploying (setting) the packer 146, the well operator may pump a completion fluid into the wellbore 102 that exhibits properties that may assist in preventing the potentially detrimental effects of formation fluid contact with the production casing 124 and the production tubing 126. In at least one embodiment, the completion fluid may comprise a corrosion inhibiting diesel 148, alternately referred to as "inhibited diesel." In other embodiments, the completion fluid may comprise any fluid operationally necessary or desired without departing from the scope of this disclosure. Once the packer 146 is set in the tubing-casing annulus 128, the corrosion inhibiting diesel 148 remains within the tubing-casing annulus 128, and the downhole assembly 134 may be conveyed into the corrosion inhibiting diesel 148 present within the tubing-casing annulus 128. The downhole assembly 134 may be configured to obtain direct measurements of the tubing-casing annulus while immersed in the corrosion inhibiting diesel 148.

With aforementioned barriers in place, as the well produces over time, installed well barriers (e.g., the production tubing 126, the packer 146, the production tubing head housing 122, etc.) may be subject to failure, resulting in a loss of well integrity. A loss of well integrity may necessitate costly remedial intervention or workover operations that require well production to be shut down. As such, operators preemptively employ methods and apparatuses to monitor the integrity of well barriers in place to locate existing and or potential failed well barriers. To accomplish this, a well operator may utilize various downhole assemblies, such as the downhole assembly 134, conveyed into the tubing-casing annulus 128 by means of the conveyance 142.

Figure 2:
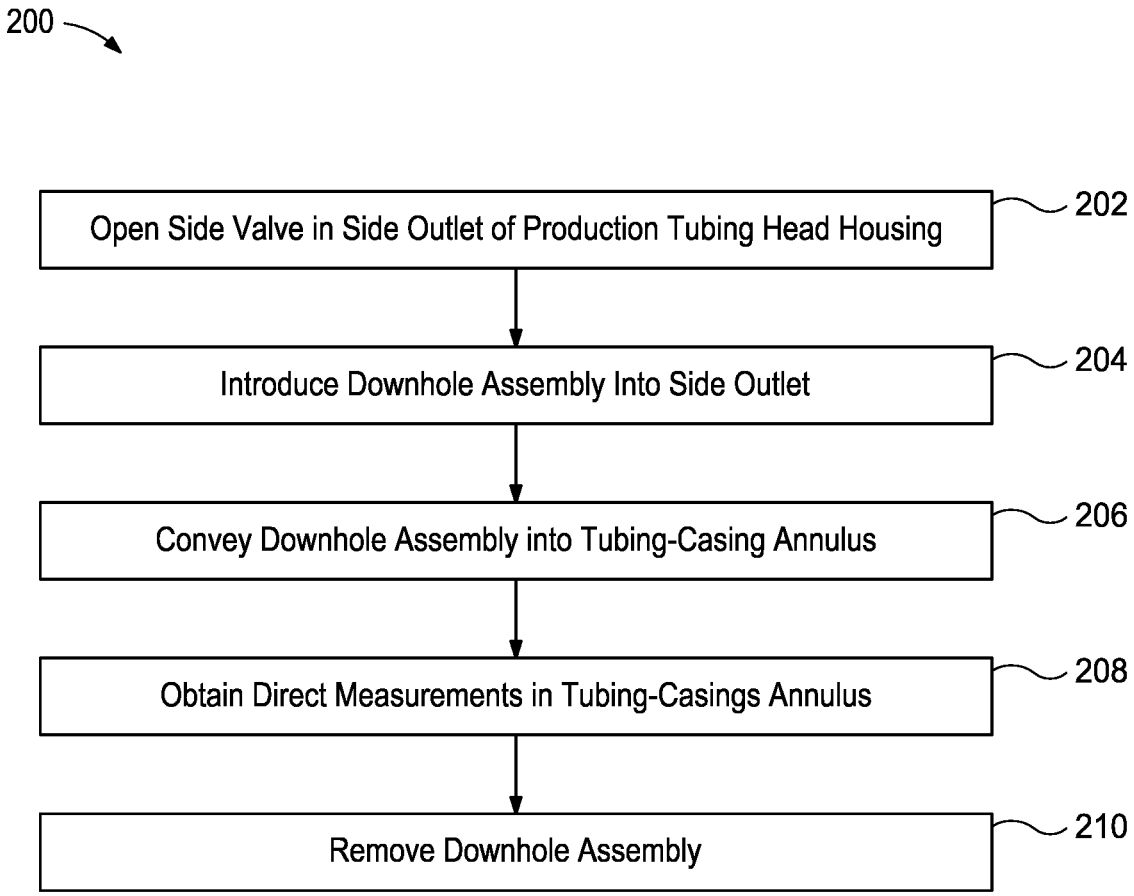
FIG. 2 is a schematic flowchart of an example method of obtaining downhole measurements that may incorporate the principles of the present disclosure.

FIG. 2 is a schematic flowchart of an example method 200 of obtaining downhole measurements that may incorporate the principles of the present disclosure. The method 200 may include opening a valve in a side outlet of a production tubing head housing forming part of a wellhead, as at 202. A wellbore may extend from the wellhead and production casing may extend from the wellhead and into the wellbore. The wellbore may also include production tubing that extends from the production tubing head housing and into the production casing, thereby defining a tubing-casing annulus between the production tubing and the production casing.

The method 200 may then include introducing a downhole assembly into the side outlet, as at 204. The side outlet may extend outwardly from the production tubing head housing at an acute angle and is in fluid communication with the tubing-casing annulus. The downhole assembly may include a variety of downhole tools, sensors, gauges, logging tools, or any combination thereof, capable of (or assisting in) detecting failures in the production casing, such as leaks or other properties indicative of a failure or potential failure.

The method 200 may then include conveying the downhole assembly into the tubing-casing annulus via the side outlet, as at 206. Direct measurements of the tubing-casing annulus may then be obtained with the downhole assembly while present within the tubing-casing annulus, as at 208. In such an embodiment, the downhole tools may record or transmit data real-time to a well operator. In some embodiments, a packer may be deployed within the tubing-casing annulus and thereby form a bottom of the tubing-casing annulus, following which corrosion inhibiting diesel may be pumped into the tubing-casing annulus. In such embodiments, the direct measurements of the tubing-casing annulus maybe obtained while the downhole assembly is immersed in the corrosion inhibiting diesel. Lastly, the method 200 may include removing the logging assembly from the wellbore by retracting the means of conveyance, as at 210.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third"

does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellhead arranged at a well surface and having a wellbore extending therefrom, the wellhead including a production tubing head housing;

production casing extending from the wellhead and into the wellbore;

production tubing extending from the production tubing head housing and into the production casing and thereby defining a tubing-casing annulus between the production tubing and the production casing;

a packer set within the tubing-casing against the production casing and the production tubing;

a corrosion inhibiting completion fluid within the tubing-casing annulus uphole from the packer;

one or more side outlets extending outwardly from the production tubing head housing at an acute angle and in fluid communication with the tubing-casing annulus; and a downhole assembly conveyable into the tubing-casing annulus via the one or more side outlets and configured to obtain direct measurements of the tubing-casing annulus.

2. The well system of claim 1, wherein each side outlet includes an outlet conduit extending from the production tubing head housing, and a gate valve arranged within the outlet conduit and operable to facilitate introduction of the downhole assembly into the production tubing head housing to access the tubing-casing annulus.

3. The well system of claim 1, wherein the downhole assembly is selected from the group consisting of a logging tool, including but not limited to a corrosion logging tool, a gamma ray tool, a noise logging tool, a directional gyro tool, and similar, as well as a temperature sensor, a pressure sensor, a flow meter, and any combination thereof.

4. The well system of claim 1, wherein the acute angle ranges between about 10° and about 75°.

5. The well system of claim 4, wherein the acute angle is 45°.

6. The well system of claim 1, further comprising a conveyance that introduces the downhole assembly into the tubing casing annulus via the one or more side outlets.

7. The well system of claim 6, wherein the conveyance is selected from the group consisting of slickline, digital slickline, wireline, coiled tubing, and any combination thereof.

8. The well system of claim 1, wherein the completion fluid comprises a corrosion inhibiting diesel pumped into the tubing-casing annulus, and wherein the downhole assembly obtains the direct measurements of the tubing-casing annulus while immersed in the corrosion inhibiting diesel.

9. The well system of claim 1, wherein the production tubing head housing provides a bowl that defines a tubing hanger, and wherein the production tubing is suspended on the tubing hanger, which provides a sealed interface.

10. The well system of claim 1, further comprising a casing head housing forming part of the wellhead, wherein the production casing extends from the casing head housing and into the wellbore.

11. The well system of claim 1, further comprising a production tree operatively coupled to and in fluid communication with the wellhead via a master valve.

12. A method of obtaining downhole measurements, comprising:

setting a packer against production casing and production tubing in a tubing-casing annulus of a wellbore extending from a wellhead and including a production tubing head housing, the production casing extending from the wellhead and into the wellbore, and the production tubing extending from the production tubing head housing and into the production casing and thereby defining the tubing-casing annulus between the production tubing and the production casing;

pumping a corrosion inhibiting completion fluid into the tubing-casing annulus uphole from the packer;

opening a valve in a side outlet of the production tubing head housing introducing a downhole assembly into the side outlet, wherein the side outlet extends outwardly from the production tubing head housing at an acute angle and is in fluid communication with the tubing-casing annulus;

conveying the downhole assembly into the tubing-casing annulus via the side outlet; and obtaining direct measurements of the tubing-casing annulus with the downhole assembly while present within the tubing-casing annulus.

13. The method of claim 12, wherein pumping the corrosion inhibiting completion fluid includes pumping corrosion inhibiting diesel into the tubing-casing annulus, and wherein the method further comprises obtaining the direct measurements of the tubing-casing annulus while the downhole assembly is immersed in the corrosion inhibiting diesel.

14. The method of claim 12, further comprising removing the downhole assembly from the tubing-casing annulus by retracting the conveyance out of the side outlet.

15. The method of claim 12, wherein the downhole assembly is selected from the group consisting of a logging tool, a temperature sensor, a pressure sensor, a flow meter, and any combination thereof.

16. The method of claim 11, wherein the acute angle of the side outlet of the production tubing head housing ranges between about 10° and about 75°.

17. The method of claim 13, wherein obtaining direct measurements comprises directly contacting a leak path in the production casing with a temperature sensor of the downhole assembly.

18. The method of claim 13, wherein obtaining direct measurements comprises detecting a flow of formation fluids into the completion fluid with a flow meter of the downhole assembly.

* * * * *